US005503518A

United States Patent [19]

Scholz

[11] Patent Number: 5,503,518

[45] Date of Patent: Apr. 2, 1996

[54] APPARATUS FOR TRANSFERRING SHEETS FROM A SUCCESSION OF STACKS

[75] Inventor: Jürgen Scholz, Oberboihingen, Germany

[73] Assignee: Womako Maschinenkonstruktionen GmbH, Nürtingen, Germany

[21] Appl. No.: 403,051

[22] Filed: Mar. 10, 1995

[30] Foreign Application Priority Data

Apr. 2, 1994 [DE] Germany ..... 44 11 597.0

[51] Int. Cl.[6] ..... B65G 57/11

[52] U.S. Cl. ..... 414/790.4; 414/798.9; 414/795.8; 198/732

[58] Field of Search ..... 414/790.4, 795.8, 414/798.9; 198/732; 271/157

[56] References Cited

U.S. PATENT DOCUMENTS

| | | | |
|---|---|---|---|
| 2,697,507 | 12/1954 | Vergobbi | 414/790.4 |
| 3,019,886 | 2/1962 | Winkler et al. | 414/790.4 |
| 3,073,460 | 1/1963 | Richert et al. . | |
| 4,618,054 | 10/1986 | Muller | 271/157 |
| 4,824,307 | 4/1989 | Johnson et al. | 414/790.4 |
| 5,011,126 | 4/1991 | Suzuki et al. | 414/795.8 |
| 5,350,055 | 9/1994 | Lecrone | 198/732 |

FOREIGN PATENT DOCUMENTS

| | | | |
|---|---|---|---|
| 2732837 | 2/1979 | Germany . | |
| 473724 | 6/1969 | Switzerland . | |
| 2197299 | 5/1988 | United Kingdom | 414/795.8 |

*Primary Examiner*—William E. Terrell
*Assistant Examiner*—Donald A. Hess
*Attorney, Agent, or Firm*—Darby & Darby

[57] ABSTRACT

Apparatus for transferring successive sheets of successive stacks of overlapping sheets at a transfer station into the range of one or more conveyors for delivery to a book assembling, pad assembling, loose leaf binder assembling or other location employs a transporting unit with a stationary bottom defining an elongated path sloping downwardly toward the transfer station. The stacks are advanced stepwise or continuously in compartments between successive partitions pivotably secured to two endless chains which advance the partitions and the stacks between them toward the transfer station. The partitions are automatically pivoted to retracted positions beneath the bottom so that an intact stack immediately upstream of the transfer station can merge into the stack which is being singularized at the transfer station. The singularizing device at the transfer station employs a stationary stop for the foremost sheet of the adjacent stack and a mechanism which transfers the thus arrested foremost sheet into the range of conveyors for delivery to the assembling location.

23 Claims, 3 Drawing Sheets

APPARATUS FOR TRANSFERRING SHEETS FROM A SUCCESSION OF STACKS

BACKGROUND OF THE INVENTION

The invention relates to improvements in apparatus for transferring sheets, panels, plates and like flat or substantially flat commodities, and more particularly to improvements in apparatus for transferring sheets and/or like commodities which are supplied to a transfer station in the form of stacks of overlapping commodities.

It is often necessary to transfer individual sheets, panels, plates or analogous commodities from a magazine to one or more spaced-apart locations. For example, it is customary to draw individual sheet-like commodities from a stack in a magazine for delivery to one or more conveyors which, in turn, advance successively withdrawn individual commodities to a station where the commodities are merged into, added to and/or otherwise associated with layers, piles or other accumulations of identical and/or different commodities. The transferred commodities can constitute front or back covers for books, pamphlets, brochures, pads or other stationery products, but such commodities can also constitute dividers for use in various types of loose leaf books, pads, catalogues or the like. Still further, the commodities can constitute pockets, advertising literature, separators, top or bottom sheets of reams of typewriter paper sheets, copy paper sheets and/or others.

The commodities can be made of paper, cardboard, plastic sheeting or paneling or combinations of two or more layers such as laminates containing two or more plies of paper, plastic, cardboard and/or metal.

The transfer of commodities in the form of sheets or the like from a stack in a magazine to a processing location does not present many problems if the thickness of each commodity is constant and if the commodites have identical sizes and shapes. However, it is much more difficult to properly transfer, at a high or very high frequency, individual commodities (e.g., in the form of pockets) having plural layers of different sizes, thicknesses and/or shapes. Thus, if the mechanism for transferring discrete commodities is designed to remove successive commodities from a stack, the dimensions of the stack are limited (i.e., the stack cannot contain a relatively large number of overlapping commodities) because the stability of a stack of commodities each of which includes (or at least some of which include) at least one relatively thick portion and a relatively thin portion is nil or close to nil as soon as the height of the stack reaches a relatively low value. Therefore, and if the commodities are to be drawn from a magazine which contains a stack of overlapping commodities, the magazine must be refilled at frequent intervals in order to avoid collapsing of stacks (consisting of commodities having portions of greater thickness and portions of lesser thickness) in the magazine proper, during introduction of stacks into the magazine or at the location of assembly of such commodities into stacks. Moreover, the operation of such apparatus must be continuously monitored by one or more persons in order to avoid unsatisfactory transfer of commodities from the magazine, unsatisfactory introduction of stacked commodities into the magazine, unsatisfactory gathering of commodities into stacks during introduction into the magazine or unsatisfactory formation of stacks outside of the magazine.

U.S. Pat. No. 3,073,460 granted Jan. 15, 1963 to Richert et al. for "Equipment for continuously charging an edgewise conveying system" discloses an apparatus wherein compression fingers affixed to two endless chains define a series of spaces for sheets which are to be advanced into the range of a suction-operated separating device. A drawback of the patented apparatus is that the compression fingers cannot adequately control the movements of sheets during advancement of sheets all the way to the separating device. Reasonably reliable guidance of the sheets is ensured only after the sheets leave the path of the compression fingers and advance along a stationary platform into the range of the separating device.

Swiss Pat. No. 473 724 granted Jun. 15, 1969 to Stobb discloses an apparatus for lifting a succession of stacks of paper sheets toward a withdrawing device which removes sheets from the top of the stack below it. Such stack is lifted by a plate which provides room for introduction of a fresh stack below it as soon as the bottom part of the expiring stack has risen to a preselected level. This apparatus cannot manipulate tall stacks of sheet-like commodities having portions of different thicknesses.

German patent application Serial No. 27 32 837 of Himmelsbach (published Feb. 8, 1979) discloses an apparatus for accumulating stacks of overlapping sheets on a platform between successive pairs of separators which advance past a rotary sheet-supplying conveyor. The inventor named in the German patent application wishes to gather coffee bags and like commodities into relatively small stacks each of which is to contain a given number of commodities.

OBJECTS OF THE INVENTION

An object of the invention is to provide an apparatus which can singularize all kinds of sheets, panels, plates, laminates and/or analogous commodities with equal facility and wherein the commodities are confined and guided in a novel and improved way during advancement to a station for singularization or withdrawal of individual commodities.

Another object of the invention is to provide the apparatus with novel and improved means for transporting stacks of substantially sheet-like commodities (which may but need not have constant thicknesses) to a transfer station.

A further object of the invention is to provide a novel and improved method of transporting stacks of overlapping sheets or analogous commodities to a sheet withdrawing or singularizing station.

An additional object of the invention is to provide the above outlined apparatus with novel and improved means for temporarily separating successive stacks of a series of stacks of paper sheets or analogous commodities from each other.

Still another object of the invention is to provide the apparatus with novel and improved means for ensuring predictable positioning of commodities arriving at the transfer station.

A further object of the invention is to provide the apparatus with novel and improved means for ensuring predictable and reliable gathering of a requisite number of stacked sheets or analogous commodities upstream of the transfer station.

Another object of the invention is to provide the apparatus with novel and improved means for merging successive stacks of sheet-like commodities on their way toward the singularizing or withdrawing station.

An additional object of the invention is to provide an apparatus which can properly manipulate larger or smaller sheet-like commodities as well as commodities of constant thickness or commodities having one or more portions of a first thickness and one or more portions of a different second thickness.

Still another object of the invention is to provide an apparatus which can be readily installed in existing production lines as a superior substitute for heretofore known apparatus for singularizing successive accumulations of overlapping sheet-like commodities.

SUMMARY OF THE INVENTION

The invention is embodied in an apparatus for transferring successive sheet-like commodities (hereinafter called sheets and intended to embrace sheets of paper or the like, panels, plates, pockets, laminates and the like) from stacks of sheets. The improved apparatus comprises sheet transporting means having a series of neighboring compartments for stacks of overlapping sheets, mobile partitions between neighboring compartments, and means for advancing the partitions in a predetermined direction along a predetermined path wherein the compartments form at least one file of successive compartments. The apparatus further comprises means for removing sheets from stacks in successive compartments arriving at a transfer station adjacent a predetermined portion of the path, and means for moving the partitions relative to the neighboring compartments not later than at the transfer station from operative positions in which the partitions separate the stacks in the neighboring compartments from each other to retracted positions in which the stack in the compartment about to reach the transfer station is free to merge into a remnant of the stack at the transfer station.

The removing means (which can also be called singularizing means if it is designed to remove one sheet at a time) can include means for arresting successive sheets or groups of sheets of the stack at the transfer station in a predetermined position, and means for evacuating (e.g., by suction and/or otherwise) successive arrested sheets or groups of sheets from the respective compartment.

The transporting means preferably further comprises a preferably stationary bottom which defines the predetermined path. The partitions are inclined relative to and extend from the bottom in their operative positions. Each compartment is preferably provided with at least one open side (e.g., the side opposite the bottom) for admission of stacks at a second portion of the predetermined path upstream of the transfer station (as seen in the predetermined direction).

The bottom preferably serves as a means for slidably supporting the stacks in compartments between those partitions which advance or which are between stages of advancement toward the transfer station. The compartments are or can be dimensioned to receive stacks of sheets which rest edgewise on the bottom. The orientation of sheets in the stacks confined in the compartments of the transporting means is preferably such that the exposed sides of the two outermost sheets of each stack in a compartment confront the partitions separating such compartment from the neighboring compartments during advancement of partitions (and during the intervals between advancements of partitions) toward the transfer station. At least a portion of the bottom preferably slopes in the predetermined direction downwardly toward the transfer station, and the angle of slope is or can be such that the stack in each compartment advancing toward the transfer station causes one of its outermost sheets (namely the foremost sheet) to abut the respective partition under the action of gravity (or because the stack fills the respective compartment from upstream partition to downstream partition).

The advancing means can comprise at least one endless conveyor for the partitions, and such at least one conveyor is or can be mounted in such a way that it includes a first reach or stretch along which the partitions advance toward the transfer station and a return reach or stretch along which the partitions advance downstream of the transfer station. The stationary bottom is adjacent those compartments which are disposed between partitions affixed to and sharing the movements of the first reach of the at least one endless conveyor.

Each partition can comprise a plurality of (e.g., two) components (e.g., in the form of elongated prongs, tines, rods, pins or the like) each having a portion movably affixed to the at least one conveyor and each movable in a slot which is provided therefor in the stationary bottom. The components are or can be substantially normal to the bottom in the operative positions of the respective partitions. The bottom is preferably disposed between the compartments on the one hand, and the first reach of the at least one conveyor and the portions of those components which are affixed to the first reach on the other hand.

The components can be affixed to the at least one conveyor (e.g., an endless chain conveyor) in such a way that they are pivotable relative to the at least one conveyor through predetermined angles (e.g., angles approaching or matching 90°).

The apparatus can further comprise means (e.g., a discrete stationary track adjacent each slot of the bottom) for locking the components of the partitions while the respective partitions assume their operative positions during advancement of their components along the first reach of the at least one conveyor toward the transfer station. The locking means (such as the aforementioned tracks) can be said to constitute a blocking device which engages the portions of the components to limit the thus engaged components to advancement relative to the bottom solely in the predetermined direction while the respective partitions share the movement of the first reach of the at least one conveyor toward the transfer station.

The moving means can include means for pivoting the portions of the components at the transfer station (e.g., slightly ahead of the transfer station) from first positions corresponding to the operative positions of the respective partitions to second positions corresponding to the retracted or inoperative positions of the respective partitions. The components of the partitions are or can be located at a level below the bottom in the second positions of their portions.

As already mentioned above, the means for locking the components of the partitions in the operative positions of the respective partitions can comprise at least one stationary track extending along the first reach of the at least one conveyor to prevent pivoting of the components during advancement toward the transfer station, and the at least one track can include a spring-biased yieldable portion which is disposed at the transfer station to permit pivoting of components from the first to the second positions of their portions. The means for pivoting the portions of components forming part of the partitions can include a mobile tilting member (e.g., in the form of a reciprocable beam extending transversely of the predetermined direction) and means (e.g., a fluid-operated motor) for moving the tilting member against the portions of components forming part of the partition which is located at least close to the transfer station.

The advancing means can include means (e.g., a stepping motor) for intermittently driving the at least one conveyor for the partitions, and means for starting the driving means including means for monitoring the position of the stack at the transfer station relative to the removing means.

The apparatus can also comprise means for detecting the presence and absence of stacks in compartments in a second portion of the predetermined path upstream of the transfer station and for initiating the introduction of stacks into unfilled compartments upon detection of a predetermined number (e.g., one, two or three) of unfilled compartments.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
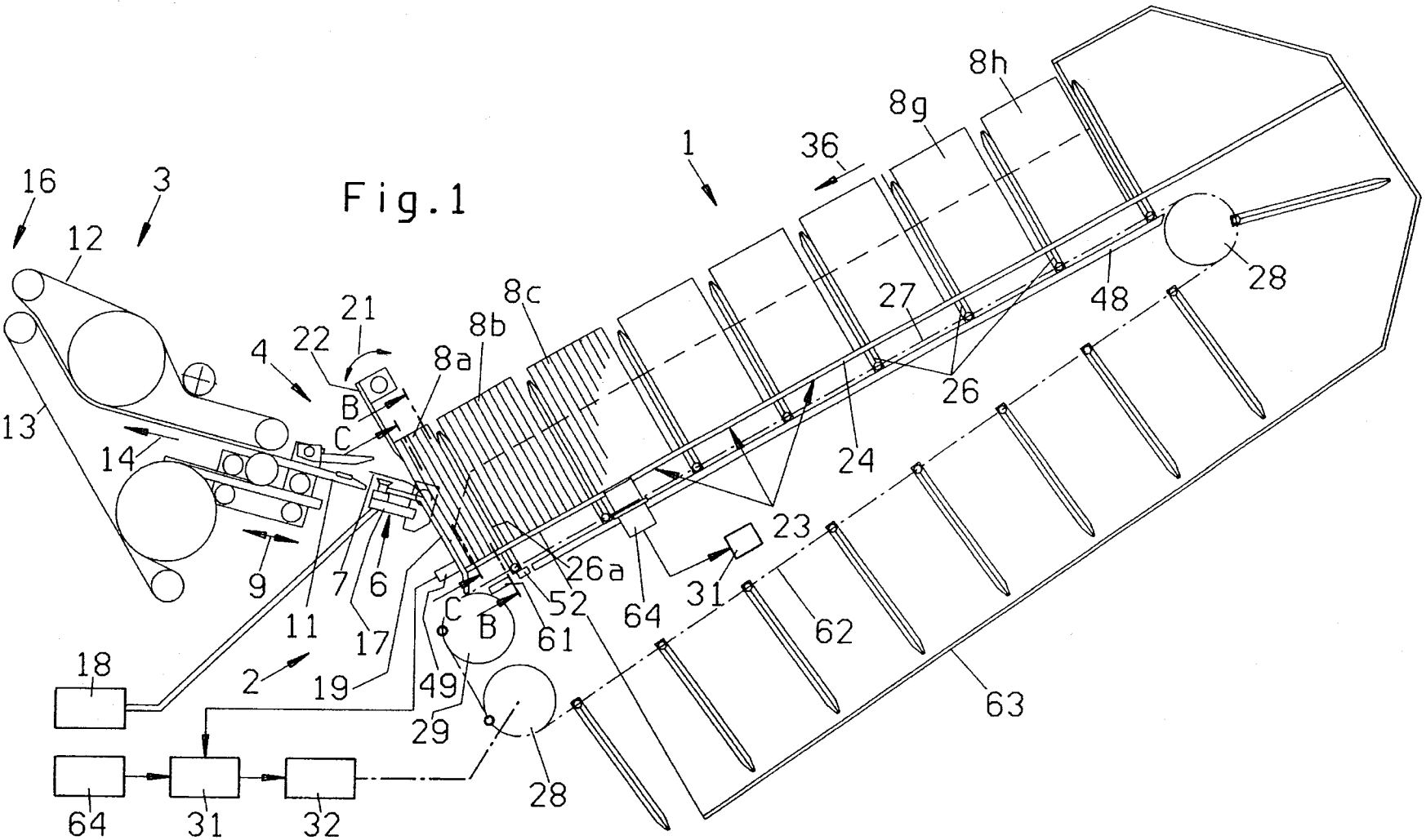
FIG. 1 is a partly diagrammatic elevational view of an apparatus which embodies one form of the invention.

FIG. 1 shows an apparatus which is used to transfer successive sheets 7 from stacks (a file of eight stacks 8*a*, 8*b*, 8*c*, . . . 8*g*, 8*h* can be actually seen in FIG. 1) in discrete compartments 23 of a stack transporting unit 1 to a remote location or station 16, e.g., to a station where the sheets 7 are inserted into, placed below, placed onto or otherwise assembled with piles or other accumulations of similar or different sheets, not shown.

The transporting unit 1 serves to advance successive stacks 8*a*, 8*b*, . . . into the range of a group 2 of devices which perform the function of delivering successive discrete sheets 7 from a transfer station 4 to the aforementioned remote location or station 16. The group 2 includes a sheet removing or stack singularizing device 6 which is installed at the transfer station 4 and transfers successive discrete sheets 7 into the range of tongs 11 or an analogous clamping device of the group 2. The clamping device 11 is reciprocable in directions indicated by a double-headed arrow 9 and delivers successive sheets 7 into the range of a composite conveying device 3 here shown as including two endless belt conveyors 12, 13 serving to advance successive sheets 7 in the direction indicated by an arrow 14 and to the remote location or station 16.

In the apparatus of FIG. 1, successive sheets 7 are positively held during transport all the way from the foremost stack 8*a* at the transfer station 4 to the remote location 16. The manner in which the sheets 7 arriving at the location 16 are processed forms no part of the present invention. By way of example only, such sheets can constitute cover sheets of pads, catalogues, books, booklets, manuals or the like; they can constitute pockets for insertion into advertising literature, diaries or address books; or they can be used as dividers in stationery products or the like.

The sheet removing device 6 includes a suction head 17 which is pivotable or rotatable about a fixed axis and is connected to a suitable suction generating device 18. The device 6 further includes a stop 22 which serves as a means for arresting successive foremost sheets 7 of the stack (8*a* in FIG. 1) at the transfer station 4 in a predetermined position for proper engagement by the suction head 17. The latter is designed to operate in such a way that it deflects a portion of the foremost sheet 7 of the stack 8*a* at the transfer station 4 into the range of the clamping device 11 which thereupon extracts the thus clamped sheet from the respective compartment 23 and advances the sheet in one of the directions indicated by the arrow 9, namely into the nip of the belt conveyors 12 and 13. The clamping device 11 causes the properly engaged sheet 7 to slide over the top of a barrier 19 extending across the path of the compartments 23 toward the transfer station 4. The stop 22 is pivoted back and forth in directions indicated by a double-headed arrow 21 to ensure that the configuration of the stepwise diminishing remnant of the stack (8*a* in FIG. 1) at the transfer station 4 is not unduly changed as a result of removal of successive sheets 7 by the device 6 in conjunction with the clamping device 11.

The entire group 2 including the removing device 6, the clamping device 11 and the conveying device 3 can be of conventional design as long as it is capable of reliably removing successive foremost sheets 7 of the stack 8*a* being located at the transfer station 4.

The path for the advancement of successive compartments 23 toward the transfer station 4 is defined by a stationary bottom 24 which can be said to form part of the transporting unit 1 and slopes (either entirely or in part) downwardly toward the transfer station 4 in the direction (arrow 36) of stepwise advancement of successive compartments 23 and the stacks therein toward the sheet removing device 6.

The neighboring compartments 23 of the file of such compartments are separated from each other by composite partitions 26 which, in accordance with a feature of the invention, are movable between operative or extended positions (FIGS. 2 and 4) and retracted or inoperative positions (FIGS. 3 and 5) at a level below the bottom 24. The partitions 26 form part of the transporting unit 1 and the latter further comprises means 27 for advancing the partitions along an endless path a portion of which coincides with the path defined by the upper side of the bottom 24 and extends toward, past and beyond the transfer station 4. The advancing means 27 of the apparatus which is shown in FIGS. 1 to 5 comprises two endless chain conveyors 37 installed in two parallel vertical planes which are spaced apart from each other as seen transversely of the direction (arrow 36) of advancement of compartments 23, partitions 26 and stacks 8*a*, 8*b*, . . . along the bottom 24 toward the transfer station 4. Each chain conveyor 37 has an elongated upper reach or first reach which is adjacent the underside of the bottom 24, and an elongated second or return reach 62 for advancement of partitions 26 beyond the transfer station 4 and back toward the upper end of the bottom 24.

The chain conveyors 37 are trained over suitable idler sprocket wheels 28 and a driven sprocket wheel 29 which latter can receive torque from a prime mover 32 (e.g., an electric stepping motor) when the prime mover is started in response to an appropriate signal from a control circuit 31.

Figure 2:
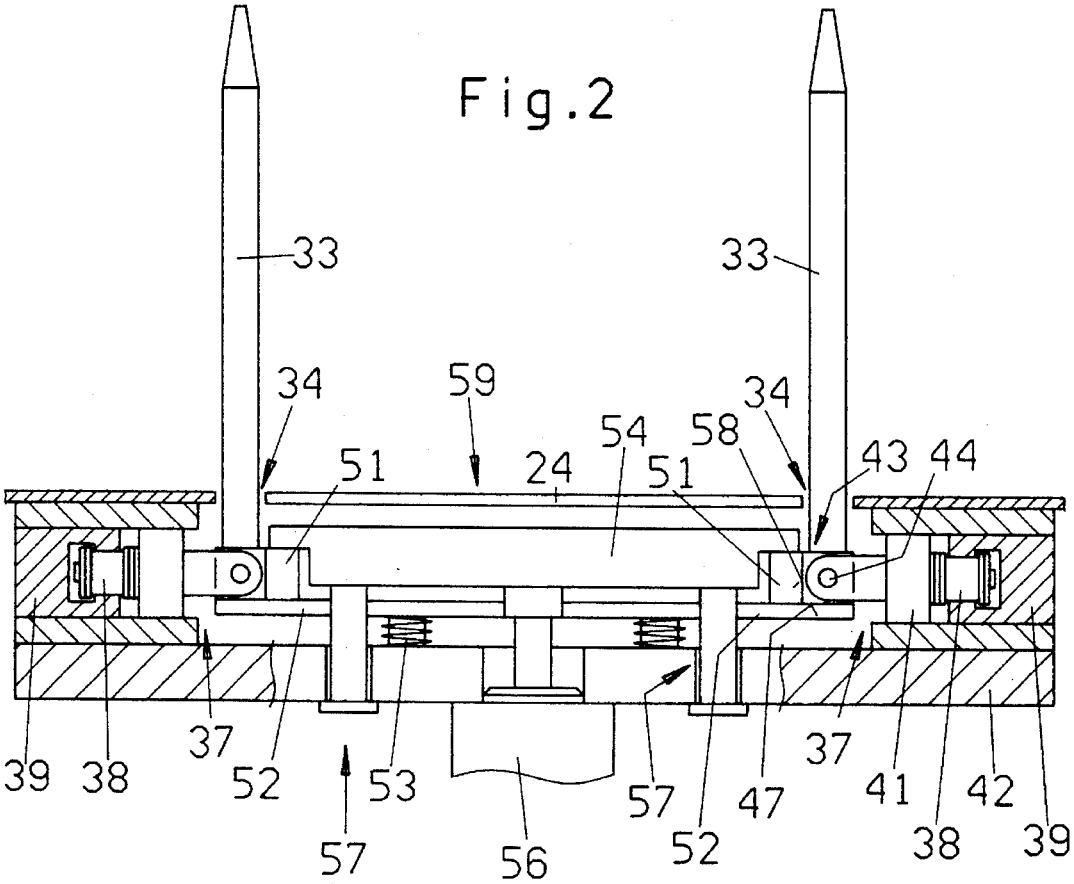
FIG. 2 is an enlarged fragmentary transverse sectional view substantially as seen in the direction of arrows from the line B—B in FIG. 1.
Figure 3:
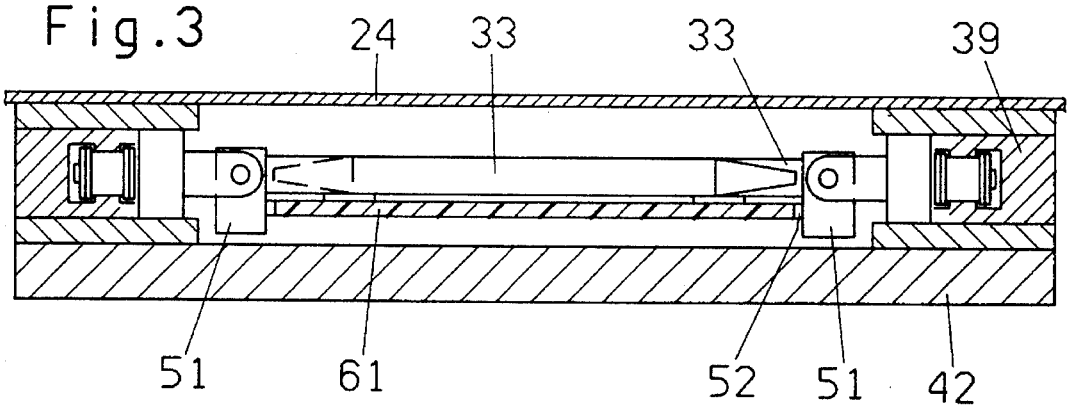
FIG. 3 is an enlarged fragmentary transverse sectional view substantially as seen in the direction of arrows from the line C—C in FIG. 1.

As can be best seen in FIG. 2, each partition 26 comprises two discrete elongated rod-, pin-, stud-, prong-, bar- or strip-shaped or analogous components 33 which are pivotable relative to each other and relative to the respective chain conveyors 37, as well as relative to the bottom 24, between the first positions of FIG. 2 (corresponding to the operative position of the respective partition 26) and the second positions of FIG. 3 (corresponding to the retracted or inoperative position of the respective partition). When they are caused to assume their first positions, the components 33 forming part of the partitions 26 adjacent the bottom 24 are normal or substantially normal to the upper side of the bottom (see also FIG. 1). The bottom 24 is provided with two spaced-apart elongated parallel slots 34, one for each component 33 of a partition 26 advancing from the top of the bottom 24 toward the transfer station 4. The partitions 26 are then operative to separate the stacks 8*a*, 8*b* . . . in neighboring compartments 23 from each other during intermittent advancement of successive stacks toward the transfer station 4, i.e., into the range of the sheet removing or stack singularizing device 6.

At least those links 38 of the chains 37 which are adjacent the underside of the bottom 24 are confined to movement in the direction as indicated by the arrow 36 due to the provision of two stationary guides 39 (FIGS. 2 and 3) which are affixed to a stationary base plate 42 below the bottom 24. At least some of the links 38 forming part of each of the chain conveyors 37 are provided with roller-shaped or other suitable followers 41 which extend into the respective guides 39 with requisite play to reduce friction between the chain conveyors 37 and the stationary structure including the bottom 24, the guides 39 and the base plate 42 when the prime mover 32 is on.

The components 33 of the partitions 26 include base portions 43 which are located at a level below the bottom 24 during advancement of the respective partitions in the direction of the arrow 36 and toward the transfer station 4. The base portions 43 are movably secured to the adjacent links 38 of the respective chain conveyors 37 by pintles 44 having axes extending in the direction of arrow 36 during advancement of the respective partitions 26 from the upper end of the bottom 24 toward the transfer station 4. As can be best seen in FIGS. 4 and 5, at least those links 38 which carry base portions 43 of the components 33 include substantially U-shaped sections or yokes 46 having parallel legs for the end portions of the respective pintles 44 and flanking the corresponding base portions 43.

The base portions 43 of the components 33 have flat surfaces or facets 47 (FIGS. 2 and 5) which abut and can slide along the complementary upper sides of two elongated tracks or rails 48 disposed beneath the bottom 24 adjacent the respective slots 34. The tracks 48 can be said to constitute a composite locking device which serves to reliably block or prevent any pivoting of the components 33 relative to the bottom 24 and the respective chain conveyors 37 during advancement of the respective partitions 26 from the upper end of the bottom 24 toward the transfer station 4. FIG. 1 shows one of the two tracks or rails 48; such track is spaced apart from the underside of the bottom 24 and the latter is located between the filled compartments 23 on the one hand, and the base portions 43 and the tracks 48 on the other hand.

In lieu of two discrete tracks 48, the improved apparatus can employ a relatively wide single track which extends all the way between the two slots 34 so that one of its marginal portions can stabilize one component 33 and its other marginal portion can stabilize the other component 33 of a partition 26 extending beyond the upper side of the bottom 24, i.e., such single track can maintain both components 33 of each partition 26 between a pair of filled compartments 23 (or between a pair of compartments capable of receiving stacks of sheets 7) in their first positions corresponding to the operative position of the respective partition.

At least some of the compartments 23 above the bottom 24 can remain empty during the initial stage of their movement toward the transfer station. The exact construction of the means for introducing individual sheets 7, groups of two or more sheets 7 or complete preassembled stacks of sheets into the compartments 23 above the bottom 24 can be of any suitable design, e.g., of the type described and shown in the aforediscussed published German patent application Serial No. 27 32 837 to Himmelsbach. All that counts is to ensure that the compartment 23 at the transfer station 4 (and preferably also the compartment immediately following the compartment 23 at 4) contains a stack of sheets 7. The nature of the illustrated sheet removing device 6 is such that it can singularize the sheets 7 of the foremost stack (8*a*) while the sheets 7 rest edgewise on the downwardly sloping upper side of the bottom 24.

The inclination of the upper side of the bottom 24 in the transporting unit 1 of the improved apparatus is selected in such a way that the exposed side of the leftmost sheet 7 in each compartment 23 containing a stack (8*b*, 8*c*, . . . ) of sheets abuts the adjacent (downstream) partition 26. At the same time, the exposed side of the other outermost (i.e., rearmost) sheet 7 in an at least partially filled compartment 23 also confronts the adjacent partition 26. At least the upper sides of those compartments 23 which are located above the bottom 24 are (or can be) at least temporarily open in order to permit convenient introduction of complete stacks of sheets 7 or individual sheets or groups of sheets which are to form stacks in the respective compartments. If the compartments 23 which are adjacent the upper side of the bottom 24 are filled by the sheets of the stacks (8*b*, 8*c*, . . . ) therein, the fact that the selected slope of the upper side of the bottom 24 enables the centrifugal force to maintain the exposed side of the foremost sheet 7 of a stack in abutment with the components 33 of the adjacent partition 26 is of no consequence.

The feature that the upper side of the bottom 24 slopes downwardly toward the transfer station 4 brings about the additional advantage that this facilitates the introduction of stacks or constituents of stacks into the compartments 23 and guarantees that each stack assumes a predetermined optimum position relative to the immediately preceding (downstream) partition 26 not later than upon arrival at a locus immediately upstream of the transfer station 4.

The prime mover 32 can be controlled (at 31) to maintain the chain conveyors 37 in uninterrupted motion, in continuous stepwise motion or to advance the chain conveyors 37 only when necessary in order to maintain the foremost sheet(s) of the foremost stack (8*a* in FIG. 1) in optimum position(s) for removal by the suction head 17 of the device 6. As shown in FIG. 1, an input of the control circuit 31 for the prime mover 32 receives signals from a monitoring device 49, and such signals are or can be used to start the prime mover if the position of the stack (8*a*) at the transfer station 4 must be changed in order to ensure predictable and optimal removal of successive sheets 7 for insertion into the clamping device 11. The monitoring device 49 can be designed to generate signals which denote the force with which the foremost sheet 7 of the stack (8*a*) at the station 4 abuts the stop 19. If the force is below a threshold value, the control circuit 31 processes the thus obtained signal into a signal which starts the prime mover 32 so that the partition 26*a* between the stacks 8*a* and 8*b* shown in FIG. 1 moves the rearmost sheet of the stack 8*a* toward the stop 19 in order to move the foremost sheet 7 of the stack 8*a* to the predetermined (optimum) position for extraction from the respective compartment 23.

The components 33 of the partition 26*a* are or can be moved out of the way (i.e., away from the path for advancement of stacks 8*b*, 8*c*, . . . toward the transfer station 4) when they assume the positions of FIG. 1 or when they move close to (e.g., slightly beyond or slightly upstream of) such positions. This enables the stack 8*b* of FIG. 1 to merge into the remnant of the stack 8*a* so that the removal of successive sheets 7 from the thus obtained combined or merged stack 8*a*+8*b* can proceed without any interruptions.

The means for moving the components 33 of successive partitions 26 out of the way to permit the stack (8*b*) in the compartment 23 immediately upstream of the transfer station 4 to merge into the remnant of the stack (8*a*) at the station 4 includes a mobile pivoting or tilting member 54 which can be moved up and down by a hydraulic or pneumatic cylinder and piston assembly 56. The base portions 43 of the components 33 are provided with followers 51. The followers 51 and the major parts of the components 33 together constitute what can be termed bell crank levers each having a longer arm extending between two stacks of sheets 7 in the first position of the respective component 33 and a shorter arm constituted by the follower 51. Each such bell crank lever is pivotable about the axis of the respective pintle 44. The components 33 are fixed in their first positions as long as the facets 47 of their base portions 43 bear against the adjacent upper sides of the respective tracks 48. Thus, the partitions 26 continue to dwell in their operative positions as long as the base portions 43 of their components 33 continue to bear against the upper sides of the respective tracks 48.

The fixed portions of the tracks 48 end slightly ahead of the transfer station 4. This can be readily seen in FIG. 1 which also shows that the tracks 48 further include yieldable portions 52 which are biased upwardly by coil springs 53 reacting against the fixed base plate 42. The springs 53 tend to maintain the yieldable portions 52 in their raised positions (FIGS. 1 and 2) in which the upper sides of such portions 52 are flush with the upper sides of the fixed major portions of the tracks 48. The prime mover 32 brings the chain conveyors 37 to a halt as soon as the base portions 43 of two components 33 forming part of a partition 26 reach the yieldable portions 52. The cylinder and piston assembly 56 is then started to move the pivoting or tilting member 54 downwardly, i.e., against the base portions 43 resting on the respective spring-biased yieldable portions 52 of the corresponding tracks 48. This causes the components 33 above the portions 52 to pivot about the axes of the corresponding pintles 44 whereby the portions 52 descend against the opposition of the associated coil springs 53 and the components 33 are compelled to pivot to their second positions (FIGS. 3 and 5) in which they are located beneath the adjacent portion of the bottom 24. In pivoting the components 33 of the partition 26 immediately upstream of the transfer station 4, the pivoting or tilting member 54 bears against the followers 51 of the base portions 43 of such components.

The pivoting or tilting member 54 is attached to rivets 57 or other suitable guides which are movably mounted in the base plate 42 and serve to confine the member 54 to reciprocatory movements in a vertical plane and transversely of the direction indicated by the arrow 36. The member 54 causes the portions 52 of the tracks 48 to descend against the opposition of the respective coil springs 53 so that the pivoted components 33 (see FIGS. 3 and 5) are reliably held in their respective second positions by the tilting member 54 (which is then urged downwardly by the cylinder and piston assembly 56) and by the respective portions 52 of the tracks 48 because the portions 52 are biased upwardly by the respective coil springs 53.

The cylinder and piston assembly 56 constitutes but one form of means for moving the tilting member 54 in a sense to pivot the followers 51 of the base portions 43, i.e., to pivot the components 33 of the partition 26*a* at the transfer station 4 to the second positions at a level below the adjacent portion of the bottom 24.

The bottom 24 is provided with a transversely extending slot 59 which is in line with the pivoting or tilting member 54 and provides room for pivoting of the components 33 beneath the bottom as soon as the cylinder and piston assembly 56 causes the member 54 to complete a downward stroke and to depress the portions 52 of the tracks 48 by way of the adjacent components 33. Once they assume their second positions (FIG. 3), the components 33 of the partition 26*a* abut the upper side of a plate-like abutment 61 which can be made of a suitable plastic material and is installed in the space between the stationary guides 39. The base portions 43 of the components 33 have additional plane surfaces or facets 58 which abut the adjacent vertically yieldable portions 52 of the corresponding tracks 48 when the components 33 of the partition 26*a* complete their pivotal movement from the first positions of FIGS. 2 and 4 to the second positions of FIGS. 3 and 5. The facets 58 are substantially vertical in the first positions and they are substantially horizontal in the second positions of the respective components 33. On the other hand, the facets 47 are substantially horizontal in the first positions and they are substantially vertical in the second positions of the respective components 33.

Figure 4:
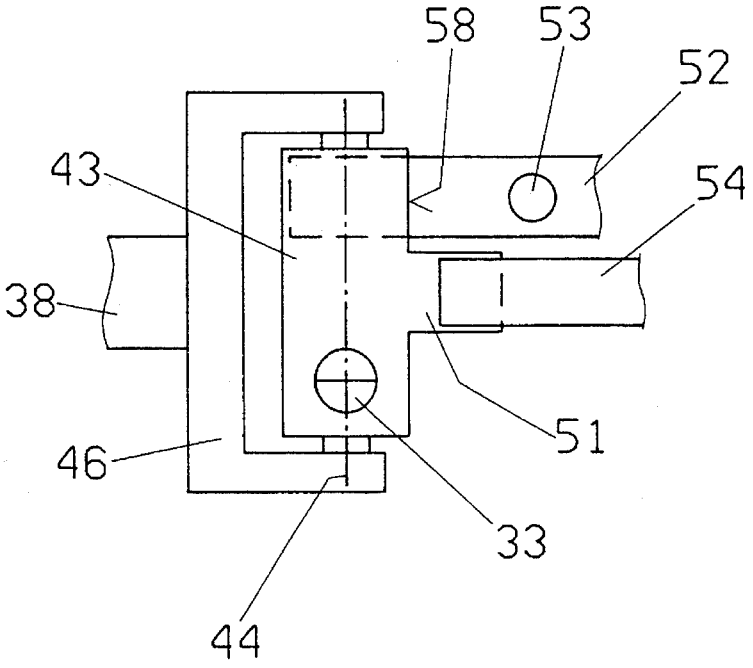
FIG. 4 is a bottom plan view of a component of one of the partitions in the operative position of the respective partition.
Figure 5:
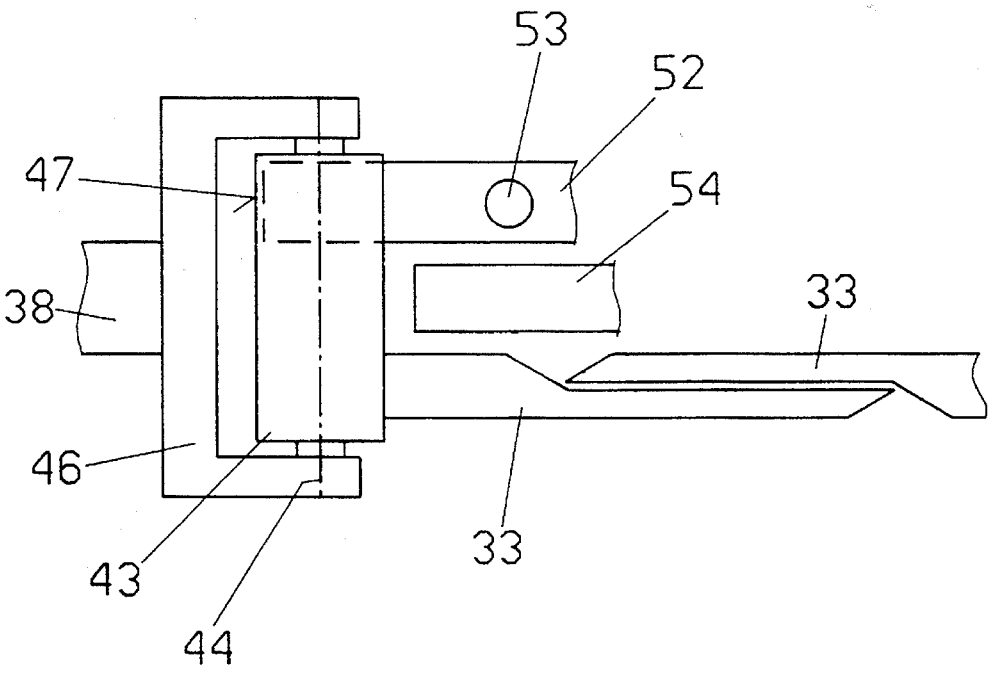
FIG. 5 is a similar bottom plan view but showing the respective partition in the retracted position.

FIG. 5 shows that the free end portions of the components 33 forming part of a partition 26 are flattened so that they can readily bypass each other during movement of such components from the first positions of FIG. 2 or 4 to the second positions which are shown in FIGS. 3 and 5.

As can be seen in FIG. 3, the components 33 of the partition 26*a* at the transfer station 4 are located entirely at a level below the adjacent portion of the bottom 24 when they are compelled to assume their second positions (corresponding to the retracted or inoperative position of the respective partition 26*a*). This ensures that the components 33 cannot interfere with the merger of the foremost intact stack (8*b* in FIG. 1) into the preceding stack (8*a* in FIG. 1), i.e., into the remnant of that stack whose sheets are being transferred by the device 6. Moreover, when they assume the positions shown in FIGS. 3 and 5, the components 33 enable the sheets 7 of the freshly merged stack 8*b* to advance toward the transfer station 4 by sliding along the adjacent portion of the bottom 24.

As already mentioned above, the abutment 61 for the components 33 (in the second positions of such components) can be made of a suitable plastic material and serves as a track along which the components 33 slide on their way past and beyond the transfer station 4. The thus advancing components 33 move beyond the respective spring-biased yieldable members 52 which are needed primarily or exclusively at a level below the vertically movable pivoting or tilting member 54 of the means for moving the components 33 to their second positions.

The components 33 which have advanced beyond the driven sprocket wheel 29 and the adjacent idler sprocket wheel 28 are no longer compelled to remain in their second positions so that they can pivot back to the first positions under the action of gravity. The thus reerected components 33 advance back toward the upper end of the bottom 24 within an enclosure or housing 63 which confines the return reach 62 of the composite conveyor 27. The housing 63 ends immediately or shortly downstream of the upper idler sprocket wheel 28 for the endless chain conveyors 37. This ensures that the compartments 23 advancing beyond the housing 63 are accessible at least from above to receive stacks of sheets 7 not later than at least slightly upstream of the transfer station 4.

The sensor 64 is shown in FIG. 1 twice. Its right-hand position (close to and somewhat upstream of the transfer station 4) is the right position. This sensor monitors the adjacent compartment for the presence or absence of a stack of sheets 7 therein. If the monitored compartment 23 is empty, this normally indicates that all of the compartments upstream of the sensor 64 are empty (it is assumed here that stacks of sheets 7 are being fed into successive compartments 23 at a single location downstream of the housing 63 and at least slightly upstream of the sensor 64). The signal from the sensor 64 then induces the control circuit 31 to generate a visible, audible and/or otherwise detectable signal which indicates to the operator(s) that the compartments 23 upstream of the sensor 64 require refilling or actually initiates introduction of sheets or entire stacks into such compartments.

An important advantage of the improved apparatus is that the magazine including the compartments 23 above the bottom 24 can store a large quantity of sheets 7 (i.e., a substantial composite pile of sheets) even if the thickness of the sheets is not uniform, e.g., if the sheets constitute pockets or like articles including several panels which only partially overlie each other. Such sheets cannot be gathered into tall or long stacks but can be readily stored, in large quantities, in the form of a file or series of neighboring relatively small stacks each of which is confined in a discrete compartment.

The feature that the partitions 26 are movable relative to the neighboring compartments 23 between operative and retracted positions renders it possible to ensure that the components 33 of the partitions cannot interfere with uninterrupted advancement of successive sheets 7 to the transfer station 4 even though the sheets are not supplied in the form of a single elongated stack but rather in the form of a file of relatively small or short stacks. The dimensions of the transporting unit 1 can be increased practically at will, i.e., the number of compartments 23 above the bottom 24 can be less than but can also exceed (and if necessary greatly exceed) the number shown in FIG. 1.

The tendency of the sheets 7 in the compartments 23 to change their inclination due to gravity (i.e., as a result of adequate selection of the angle of slope of the upper side of the bottom 24) is actually an advantage because this facilitates the merger of the foremost complete stack (such as **8*b* in FIG. 1) into the remnant of the preceding stack (8*a* in FIG. 1) when the need arises, i.e., when the components 33 of the partition 26*a* immediately or closely upstream of the transfer station 4 are to be pivoted from the first positions of FIGS. 2 and 4 to the second positions of FIGS. 3 and 5. Moreover, the inclination of the upper side of the bottom 24 downwardly toward the transfer station 4 in the direction (arrow 36) of advancement of partitions 26 toward the sheet removing or singularizing device 6 enables the force of gravity to assist in the advancement (sliding movements) of the sheets 7 and the stacks of such sheets along the bottom 24 and toward the stop 19. A substantial portion of the weight of each stack of sheets 7 is borne by the partition 26 immediately in front of such stack so that the extent of frictional engagement between the lower edges of the sheets 7 and the upper side of the bottom 24** is not very pronounced.

The dimensions, the material and hence the strength of the components 33 of the partitions 26 can be selected practically at will. Furthermore, it is clear that the illustrated means for pivoting the components 33 between their first and second positions can be modified or replaced with different means without departing from the spirit of the present invention.

The aforediscussed design of the transporting unit 1 including the bottom 24, the partitions 26 and the compartments 23 renders it possible to confine large quantities of sheets 7 upstream of the transfer station 4 without risking misalignment of sheets relative to each other in a given compartment and/or misalignment of neighboring stacks relative to each other. This, in turn, renders it possible to avoid continuous visual monitoring of the supply of sheets upstream of the transfer station 4 as well as to automate the admission of sheets and stacks into the compartments and the advancement of sheets and stacks along the bottom 24 and toward the sheet removing device 6.

Still another important advantage of the apparatus is its compactness as well as its simplicity. Thus, a substantial quantity of sheets 7 can be maintained in a state of readiness for advancement toward the transfer station 4 by resorting to very simple and inexpensive parts and to simple, compact and reliable control elements. The apparatus can be installed in many existing production lines for the making of stationery products and/or any other products wherein discrete sheets or groups of predetermined numbers of sheets must be transferred from a magazine to a remote location with a high degree of reliability irrespective of the exact nature of the transferred commodities.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for transferring successive discrete sheets from stacks of sheets, comprising sheet transporting means having a series of neighboring compartments for stacks of overlapping sheets, mobile partitions between neighboring compartments of said series, and means for advancing said partitions in a predetermined direction along a predetermined path wherein said compartments form at least one file of successive compartments; means for removing discrete sheets from stacks in successive compartments arriving at a transfer station adjacent a predetermined portion of said path; and means for moving said partitions relative to the neighboring compartments at said station from operative positions in which the partitions separate the stacks in the neighboring compartments from each other to retracted positions in which the stack in the compartment about to reach said station is free to merge into the stack at said station.

2. The apparatus of claim 1, wherein said removing means includes means for arresting successive sheets of the stack at said station in a predetermined position and means for evacuating successive arrested sheets from the respective compartment.

3. The apparatus of claim 1, wherein said transporting means further comprises a bottom defining said path and said partitions are inclined relative to and extend from said bottom in the operative positions thereof.

4. The apparatus of claim 1, wherein each of said compartments has at least one open side for admission of stacks at a second portion of said path upstream of said transfer station.

5. The apparatus of claim 1, wherein said transporting means further comprises a stationary bottom defining said path and slidably supporting the stacks in the compartments disposed between those partitions which advance toward said transfer station.

6. The apparatus of claim 5, wherein said compartments are dimensioned to receive the stacks of sheets resting edgewise on said bottom, the stacks in said compartments including outermost sheets having exposed sides with each exposed side confronting one of said partitions during advancement of said partitions toward said transfer station.

7. The apparatus of claim 6, wherein said bottom includes a portion sloping in said direction downwardly toward said transfer station at an angle such that the stack in each compartment advancing toward said station causes one of its outermost sheets to abut the respective partition under the action of gravity.

8. The apparatus of claim 1, wherein said advancing means comprises at least one endless conveyor for said partitions, said conveyor having a first reach along which said partitions advance toward said transfer station and a return reach along which said partitions advance downstream of said transfer station.

9. The apparatus of claim 8, wherein said transporting means further comprises a stationary bottom slidably supporting the stacks in the compartments disposed at said first reach of said at least one conveyor.

10. The apparatus of claim 9, wherein each of said partitions comprises a plurality of components, each component having a portion movably affixed to said at least one conveyor and each component being movable in a slot provided therefor in said bottom.

11. The apparatus of claim 1, wherein said advancing means includes at least one conveyor for said partitions, means for intermittently driving said at least one conveyor, and means for starting said driving means including means for monitoring the position of the stack at said transfer station relative to said removing means.

12. The apparatus of claim 1, further comprising means for detecting the presence and absence of stacks in the compartments disposed in a second portion of said path upstream of said transfer station and for initiating the introduction of stacks into unfilled compartments upon detection of a predetermined number of said unfilled compartments.

13. Apparatus for transferring successive sheets from stacks of sheets, comprising sheet transporting means having a series of neighboring compartments for stacks of overlapping sheets, mobile partitions between neighboring compartments of said series, and means for advancing said partitions in a predetermined direction along a predetermined path wherein said compartments form at least one file of successive compartments; means for removing sheets from stacks in successive compartments arriving at a transfer station adjacent a predetermined portion of said path, said advancing means comprising at least one endless conveyor for said partitions, said at least one endless conveyor having a first reach along which said partitions advance toward said transfer station and a return reach along which said partitions advance downstream of said transfer station, said transporting means further comprising a stationary bottom slidably supporting the stacks in the compartments disposed at said first reach of said at least one endless conveyor, each of said partitions comprising a plurality of components and each component having a portion movably affixed to said at least one endless conveyor and each component being movable in a slot provided therefor in said bottom; and means for moving said partitions relative to the neighboring compartments not later than at said transfer station from operative positions in which the partitions separate the stacks in the neighboring compartments from each other to retracted positions in which the stack in the compartment about to reach said transfer station is free to merge into the stack at said transfer station.

14. The apparatus of claim 13, wherein said components are elongated and are substantially normal to said bottom in the operative positions of the respective partitions.

15. The apparatus of claim 14, wherein said bottom is disposed between said compartments and said first reach and said portions of components are affixed to said first reach.

16. The apparatus of claim 15, wherein said components are pivotable relative to said at least one conveyor through predetermined angles.

17. The apparatus of claim 14, further comprising means for locking said components in the operative positions of the respective partitions during advancement of said components along said first reach toward said transfer station.

18. The apparatus of claim 17, wherein said locking means comprises a stationary blocking device which engages said portions of said components to limit the engaged components to advancement relative to said bottom solely in said direction while the respective partitions share the movement of said first reach toward said transfer station.

19. The apparatus of claim 17, wherein said locking means comprises stationary tracks adjacent the slots in said bottom.

20. The apparatus of claim 13, wherein said components are pivotable relative to said bottom and said moving means includes means for pivoting said portions of said components at said transfer station from first positions corresponding to the operative positions to second positions corresponding to the retracted positions of the respective partitions.

21. The apparatus of claim 20, wherein said components are located at a level below said bottom in the second positions of said portions thereof.

22. The apparatus of claim 21, further comprising at least one stationary track for said portions of said components, said at least one track extending along said first reach to prevent pivoting of said components during advancement toward said transfer station and said at least one track including a spring-biased yieldable portion disposed at said station to permit pivoting of components from said first to said second positions of said portions thereof.

23. The apparatus of claim 20 wherein said means for pivoting includes a mobile tilting member and means for moving said tilting member against the portions of those components which form part of a partition located at least close to said transfer station.

* * * * *